US008875935B2

(12) United States Patent
Willat et al.

(10) Patent No.: US 8,875,935 B2
(45) Date of Patent: Nov. 4, 2014

(54) WINE GLASS

(71) Applicant: By The Glass, LLC, Venice, CA (US)

(72) Inventors: Boyd I. Willat, Venice, CA (US); Joseph T. Perrulli, St. Helena, CA (US); Paul H. Velick, Santa Monica, CA (US)

(73) Assignee: govino, LLC, St. Helena, CA (US)

( * ) Notice: Subject to any disclaimer, the term of this patent is extended or adjusted under 35 U.S.C. 154(b) by 0 days.

(21) Appl. No.: 14/045,587

(22) Filed: Oct. 3, 2013

(65) Prior Publication Data

US 2014/0027462 A1 Jan. 30, 2014

Related U.S. Application Data

(63) Continuation of application No. 11/309,159, filed on Jul. 3, 2006, now Pat. No. 8,567,635, which is a continuation-in-part of application No. 10/979,847, filed on Nov. 1, 2004, now Pat. No. 7,273,147.

(60) Provisional application No. 60/592,809, filed on Jul. 29, 2004, provisional application No. 60/517,755, filed on Nov. 5, 2003.

(51) Int. Cl.
*B65D 1/04* (2006.01)

(52) U.S. Cl.
USPC ..... 220/608; 220/506; 220/505; 220/575

(58) Field of Classification Search
USPC ..... 220/608, 506, 575, 505
See application file for complete search history.

(56) References Cited

U.S. PATENT DOCUMENTS

| | | | |
|---|---|---|---|
| 1,075,119 | A | 10/1913 | Reichner |
| 1,201,284 | A | 10/1916 | Gilchrist |
| 1,661,336 | A | 3/1928 | Katz |
| 1,667,776 | A | 5/1928 | Elofson |
| 1,710,951 | A | 4/1929 | Shaweker |
| 1,744,328 | A | 1/1930 | Morely |
| 1,748,483 | A | 2/1930 | Hyde |
| D90,082 | S | 6/1933 | Piazzoli |
| 2,021,495 | A | 11/1935 | Anderson |
| 2,036,407 | A | 4/1936 | Godfrey |
| 2,077,027 | A | 4/1937 | Torras |
| D120,226 | S | 4/1940 | Lundy |
| 2,208,431 | A | 7/1940 | Rochow |
| 2,271,822 | A | 2/1942 | Hills |

(Continued)

FOREIGN PATENT DOCUMENTS

WO WO9504679 2/1995

*Primary Examiner* — Stephen Castellano
(74) *Attorney, Agent, or Firm* — Lowry Blixseth LLP; Scott M. Lowry

(57) ABSTRACT

A wine glass constructed from molded plastic includes an upper body defining an upwardly narrowed flume for concentrating the wine bouquet, in combination with a contoured lower base defining an annular moat surrounding a central punt for enhanced visual inspection of the wine. In addition, the upper body further includes a notched indent at an outboard side thereof forming a shelf for facilitated fingertip grasping and manipulation of the assembled glass. In one form, the upper body and lower base of the wine glass are provided as separate modules adapted for assembly to form the wine glass, and disassembly for respective compact stacking. In another form, the wine glass has a one-piece construction adapted for compact stacking by nested reception of the upwardly narrowed flume partially into the underside of the lower base of an overlying glass in the stack.

36 Claims, 4 Drawing Sheets

(56) References Cited

U.S. PATENT DOCUMENTS

| | | | | |
|---|---|---|---|---|
| 2,352,205 | A | | 6/1944 | Karlson |
| 2,373,551 | A | | 4/1945 | De Lauder |
| D151,431 | S | | 10/1948 | Cooper et al. |
| 2,592,485 | A | | 4/1952 | Stair |
| 2,831,651 | A | | 4/1958 | Hutchings |
| 2,962,201 | A | | 11/1960 | Brillis et al. |
| 2,965,274 | A | | 12/1960 | Brillis et al. |
| 2,988,258 | A | | 6/1961 | Witzke |
| 2,990,981 | A | | 7/1961 | Schmitt et al. |
| 3,074,263 | A | | 1/1963 | Farmer |
| 3,397,867 | A | | 8/1968 | Hoff |
| 3,405,858 | A | | 10/1968 | Collie |
| 3,434,626 | A | | 3/1969 | Kinslow, Jr. |
| 3,441,173 | A | | 4/1969 | Edwards |
| 3,443,715 | A | | 5/1969 | Edwards |
| 3,464,587 | A | | 9/1969 | Edwards |
| 3,471,055 | A | | 10/1969 | Edwards |
| 3,677,524 | A | | 7/1972 | Douglas |
| 3,727,783 | A | | 4/1973 | Carmichael |
| 3,730,385 | A | | 5/1973 | Rost |
| 3,759,410 | A | | 9/1973 | Uhlig |
| 3,784,052 | A | | 1/1974 | Edwards |
| 3,820,692 | A | | 6/1974 | Swett et al. |
| D233,297 | S | | 10/1974 | Raymer |
| 3,838,772 | A | | 10/1974 | Lang et al. |
| 3,934,725 | A | | 1/1976 | Edwards |
| 3,971,471 | A | | 7/1976 | Ludder |
| 3,995,740 | A | | 12/1976 | Amberg et al. |
| 4,003,555 | A | | 1/1977 | Swartz |
| 4,044,889 | A | | 8/1977 | Orentreich et al. |
| 4,054,219 | A | | 10/1977 | Young et al. |
| 4,082,184 | A | | 4/1978 | Hammer |
| D248,916 | S | | 8/1978 | Reynolds et al. |
| 4,156,483 | A | | 5/1979 | Day |
| 4,197,948 | A | | 4/1980 | Amberg et al. |
| 4,249,666 | A | | 2/1981 | Hubert et al. |
| 4,410,085 | A | | 10/1983 | Beneziat et al. |
| D276,115 | S | | 10/1984 | Wiedeman |
| 4,577,775 | A | | 3/1986 | Kresin |
| 4,609,113 | A | | 9/1986 | Seki |
| 4,610,351 | A | | 9/1986 | Coles et al. |
| 4,770,519 | A | | 9/1988 | Jacques |
| 4,818,114 | A | | 4/1989 | Ghavi |
| 4,832,212 | A | | 5/1989 | Askinazi |
| 4,889,752 | A | * | 12/1989 | Beck ..... 428/36.92 |
| 4,978,015 | A | | 12/1990 | Walker |
| 4,993,566 | A | | 2/1991 | Eberle |
| 5,054,661 | A | | 10/1991 | Hollje |
| 5,071,015 | A | * | 12/1991 | Kinslow ..... 215/375 |
| 5,094,543 | A | | 3/1992 | Mursa |
| D337,187 | S | | 7/1993 | Hampshire |
| 5,339,975 | A | | 8/1994 | Stoner |
| 5,503,283 | A | | 4/1996 | Semersky |
| 5,507,402 | A | | 4/1996 | Clark |
| 5,547,275 | A | | 8/1996 | Lillelund et al. |
| D379,738 | S | | 6/1997 | Liming et al. |
| D381,558 | S | | 7/1997 | Schaefer et al. |
| 5,785,197 | A | | 7/1998 | Slat |
| 5,788,369 | A | | 8/1998 | Tseng |
| 5,887,740 | A | | 3/1999 | Hong |
| 5,913,964 | A | | 6/1999 | Melton |
| 6,095,033 | A | | 8/2000 | Melton |
| 6,138,862 | A | | 10/2000 | Tai |
| D436,295 | S | | 1/2001 | Furman et al. |
| 6,189,724 | B1 | | 2/2001 | Lin |
| D446,687 | S | | 8/2001 | Furman et al. |
| 6,332,704 | B1 | | 12/2001 | Gasser et al. |
| 6,409,374 | B1 | | 6/2002 | Willat |
| D459,946 | S | | 7/2002 | Willat |
| 6,644,846 | B2 | | 11/2003 | Willat |
| 2001/0022304 | A1 | | 9/2001 | Roche |

* cited by examiner

WINE GLASS

This application is a continuation of Ser. No. 11/309,159 filed Jul. 3, 2006, now U.S. Pat. No. 8,567,635, which is a continuation-in-part of Ser. No. 10/979,847 filed Nov. 1, 2004, now U.S. Pat. No. 7,273,147, which claims benefit of provisional Ser. No. 60/592,809 filed Jul. 29, 2004 and provisional Ser. No. 60/517,755 filed Nov. 5, 2003.

BACKGROUND OF THE INVENTION

This invention relates generally to improvements in wine glasses which may be constructed from relatively lightweight and cost efficient plastic materials. More specifically, this invention relates to an improved wine glass of modular or unitary construction, wherein the assembled wine glass is easily grasped and is shaped to facilitate inspection of the bouquet and visual characteristics of a selected wine, and further wherein a plurality of wine glasses or modular components thereof are shaped for relatively compact stacking for convenient shipping and/or storage.

Wine is commonly served at a wide variety of social gatherings and events ranging from small to large, and from informal to formal. In this regard, it is generally recognized that the olfactory, visual and taste characteristics of any given wine are best displayed and best judged by use of a traditional transparent wine glass having a rounded or bowl-shaped bottom of expanded cross sectional size relative to an upwardly and inwardly tapering upper flume. This classic wine glass shape enables close visual inspection of wine color and meniscus and other visual characteristics by swirling a small amount of the wine within the bowl-shaped bottom of the glass, while the narrowing upper flume tends to concentrate the bouquet of the wine for facilitated sensory detection and enjoyment. Traditionally, such wine glasses have been constructed from glass, typically by supporting the bowl-shaped bottom of the glass on a narrow stem which projects upwardly from a disk-shaped lower base.

Wine glasses constructed from glass, however, are fragile and thus susceptible to breakage during normal use, and in the course of shipping and handling prior to use, and further in the course of post-use handling including washing, drying and returning the glasses to storage. In addition, a set of glass-constructed wine glasses can be relatively costly, particularly when large numbers of glasses are required for use at a social event. Moreover, the shape of the traditional wine glass, including the narrowed upper flume, inherently precludes compact stacking of multiple glasses for space-efficient shipping and storage.

As a result, alternative drinking vessels or cups formed from relatively inexpensive and substantially unbreakable molded plastic are often used for serving wine, in lieu of traditional glass-constructed wine glasses. Such plastic molded cups are relatively inexpensive and thus suitable for disposal following a single use. In some configurations, such molded plastic cups have incorporated surface features designed to enhance the various visual, olfactory and taste characteristics of wine. See, for example, U.S. Pat. Nos. 6,409,374 and 6,644,846, which are incorporated by reference herein. However, such molded plastic cups are commonly formed with an upwardly expanding cross sectional shape so that the cups can be shipped and stored in a compact stacked array, but this upwardly expanding shape does not concentrate the wine bouquet. Accordingly, plastic molded cups have generally been incompatible with optimally displaying to best advantage the full range of characteristics attributable to a particular vintage, and do not optimize the presentation and enjoyment of the wine.

There exists, therefore, a need for further improvements in and to wine glasses of the type constructed from molded plastic, wherein the wine glass is shaped for optimizing the presentation and enjoyment of wine. The present invention fulfills these needs and provides further related advantages.

SUMMARY OF THE INVENTION

In accordance with the invention, a wine glass constructed from molded plastic comprises an upper body defining an upwardly narrowed flume for concentrating the wine bouquet, in combination with a contoured lower base defining an annular moat surrounding a central punt for enhanced visual inspection of the wine. In addition, the upper body of the wine glass further includes a notched indent at an outboard side thereof defining a generally horizontal and upwardly presented shelf for facilitated fingertip grasping and manipulation of the assembled glass, to correspondingly facilitate close inspection of bouquet and visual characteristics of wine contained therein.

In one preferred form of the invention, the upper body and lower base of the wine glass comprise separately formed modular components formed as by injection molding or the like. The modular upper body is adapted for quick and easy, substantially leak-proof assembly with the modular lower base to form an assembled wine glass having the upwardly narrowed flume in combination with the lower annular moat surrounding a central punt. This central punt may have an upwardly convex, generally hemispherical shape for enhanced visual inspection wine contained within the annular moat. The modular upper body and lower base are adapted for quick and easy disassembly for respective compact stacking of the separated modular components.

In an alternative preferred form of the invention, the upper body and lower base of the wine glass are formed with a unitary or one-piece construction as by blow molding or the like to define the upwardly narrowed flume in combination with the lower annular moat surrounding a central punt, and further defining the external notched indent. The central punt may circumscribe an upwardly concave central inner cup of predetermined or metered volumetric capacity for pour-in reception of a measured quantity of wine. The one-piece glass is adapted for compact stacking in a filled or unfilled state by reception of the upwardly narrowed flume at least partially into an annular cavity formed at the underside of the lower base of an overlying glass in the stack, at an inboard or radially inward position relative to the adjoining annular moat.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
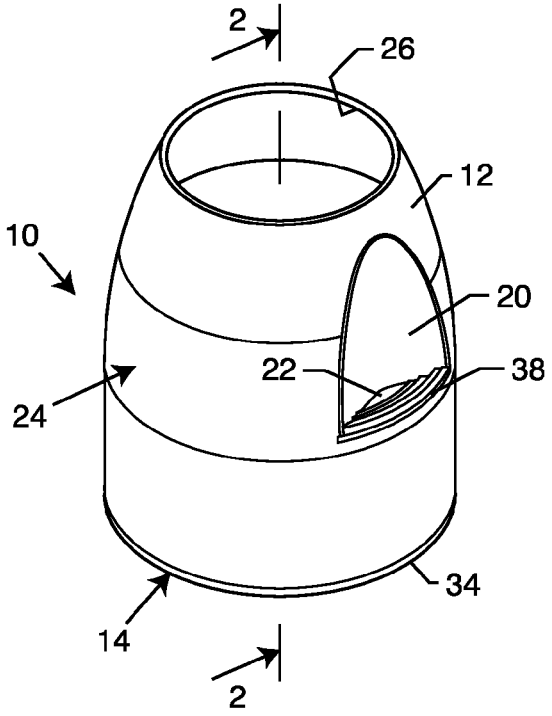
FIG. 1 is a perspective view illustrating a module wine glass constructed in accordance with one preferred form of the present invention.
Figure 5:
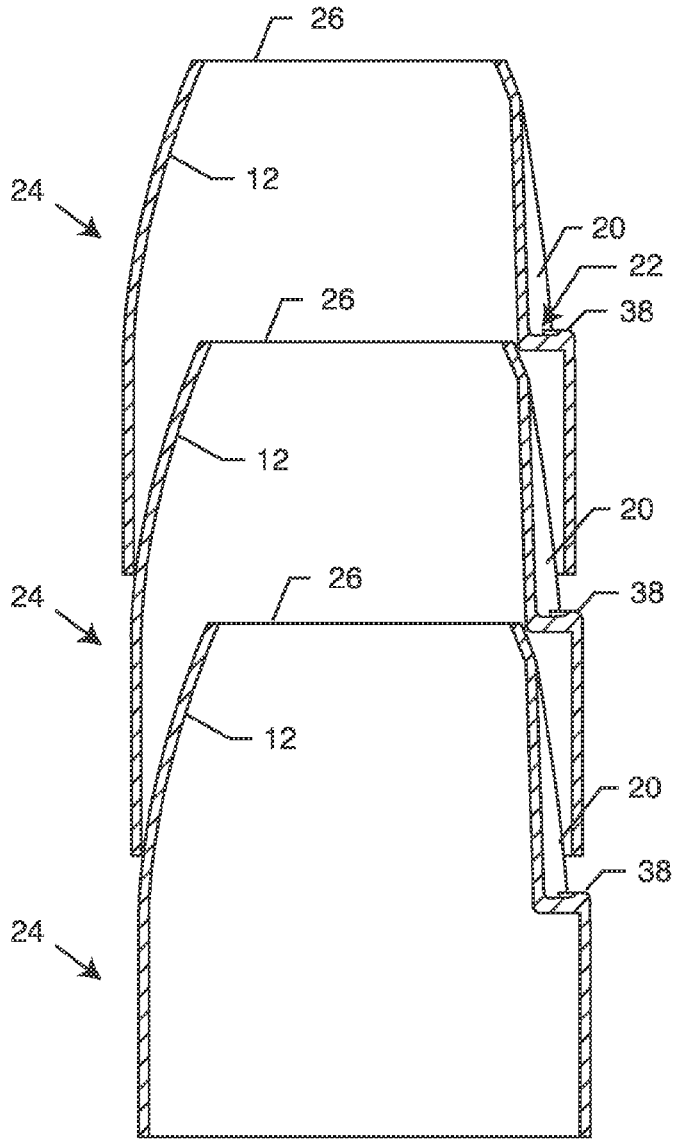
FIG. 5 is an enlarged vertical sectional view illustrating multiple upper body components for a plurality of wine glasses arranged in compact stacked relation.
Figure 6:
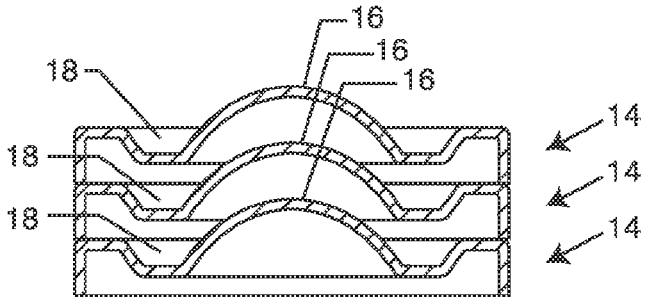
FIG. 6 is an enlarged vertical sectional view illustrating multiple lower base components for a plurality of wine glasses arranged in compact stacked relation.

As shown in the exemplary drawings, a wine glass referred to generally in FIG. 1 by the reference numeral 10 is constructed from molded plastic. In one preferred form (FIGS. 1-6), the wine glass has a modular construction defined by separately formed modular components adapted for quick and easy assembly to provide a leak-proof drinking vessel (FIGS. 1-4) particularly suited for drinking and/or sampling wine, and wherein these plastic modular components are further adapted in an unassembled state for compact nested stacking (FIGS. 5-6). In an alternative preferred form (FIGS. 7-10), a modified wine glass 110 has a unitary or one-piece construction adapted for relatively compact and partially nested stacking in a filled or unfilled state.

The wine glass of the present invention is formed with a geometric shape designed for enhanced enjoyment of substantially the full range of characteristics attributable to a specific wine. More particularly, the wine glass incorporates an upper flume 12 of upwardly narrowing cross sectional shape for concentrating the wine aroma or bouquet. In addition, a lower region or bottom of the wine glass includes a contoured lower base 14 defining a central upstanding punt 16 surrounded by a recessed annular moat 18, wherein the punt 16 and moat 18 accommodate enhanced visual inspection of a small quantity of the wine contained and/or swirled within the moat 18. Further, the wine glass incorporates an external notched indent 20 defining a relatively shallow, upwardly presented and substantially horizontal exterior shelf 22 sized for convenient fingertip engagement, thereby facilitating fingertip grasping and manipulation of the wine glass. All of these features are provided in a relatively simple and cost-efficient construction suitable for formation by plastic molding processes.

As viewed in FIGS. 1-4, the illustrative modular wine glass 10 includes an upper shell-shaped body 24 in combination with the lower base 14, wherein these two components or modules are each adapted for construction by plastic molding or the like and subsequent assembly in substantially leak-proof relation. While a variety of different plastic materials may be used, one preferred plastic material comprises a substantially transparent polystyrene or the like having a density, strength and clarity conducive to close visual inspection of a beverage such as wine contained in the assembled glass, and suitable for relative economic production of the modular components as by injection molding or the like.

The upper body 24 has a generally circular cross sectional shape extending upwardly from a lower end, with at least some radially inward taper to accommodate formation by injection molding processes, with quick and easy release of the molded body 24 from an appropriately shaped mold cavity or die (not shown). In accordance with one key aspect of the invention, an upper region of this generally cylindrical tapered upper body defines the flume 12 having a more sharply or more significantly radially inwardly tapered cross sectional shape, corresponding closely with the inwardly tapered upper flume zone of a conventional wine glass constructed from a fragile glass material, terminating in an open upper mouth 26 of reduced cross sectional size. This flume 12 of upwardly narrowing cross sectional area beneficially concentrates the aroma or bouquet of wine contained within the assembled modular glass 10.

At least one annular seal rib 28 (shown best in FIG. 4) is formed within the interior of the upper body 24 at a location spaced closely from a lower end thereof. This seal rib 28 is sized and shaped for interference, preferably snap-fit reception into a generally matingly shaped seal groove 30 (FIGS. 3-4) formed on the outboard side of a generally cylindrical outer wall 32 on the lower base component 14. A radially outwardly protruding lip 34 may be formed at a lower margin of the outer wall 32, for overlying and bearing against a lower margin of the upper body 24, when the two components are snap-fit assembled together. The seal rib 28 and associated seal groove 30 are sized and shaped to provide a substantially sealed or leak-proof interconnection or joint that may thus be disposed below the level of liquid contained within the assembled glass.

Alternately, persons skilled in the art will recognize and appreciate that the positions of the seal rib 28 and seal groove 30 may be reversed, i.e., that the seal rib 28 may be formed on the outer wall 32 of the lower base 14 for interference, substantially snap-fit reception into the associated seal groove 30 formed within the upper body 24 near the lower end thereof. Moreover, if desired, one or both of the seal rib 28 and the seal groove 30 may be coated with a thin film seal agent, such as a thin coating of a curable silicon-based gel or similar resilient seal material.

An upper margin of the outer wall 32 of the lower base 14 is molded integrally with a radially inwardly extending base plate defined by an outer annular segment 36 which cooperates with the axially centered and preferably upwardly convex, half-round or hemispherical punt 16 to form the upwardly open recessed annular moat 18 therebetween. As shown, the vertical dimension of the punt 16 preferably extends at least a short distance above the plane of the outer segment 36. The resultant volume of the moat 18, defined by the volume disposed below the plane of the outer segment 36, preferably comprises a predetermined volume for containing a predetermined quantity of a beverage such as wine, such as a volume on the order of about one fluid ounce or other selected volume suitable for sampling and assessing the characteristics of a particular wine. The shape of the punt 16, constructed from molded and preferably transparent plastic material, beneficially functions as a refracting or reflecting lens to enhance the light passing through wine contained within the moat 18, for correspondingly enhanced visual inspection of the wine color, clarity and meniscus.

In accordance with one important aspect of the invention, the outer annular segment 36 effectively cooperates with the shape of the recessed moat 18 and the central punt 16 to form a radially stiff construction for the lower base component 14.

Accordingly, radially inward pressure applied to the lower base 14, by pressing inwardly on the upper body 24 in the region of the seal lip 28, does not result in radially inward deformation of the lower base 14. Such radially inwardly deformation of the lower base 14 would undesirably deflect the interfitting seal rib 28 and seal groove 30, with resulting potential for undesirable leakage of liquid past the seal structure. The stiff geometry of the lower base 14 functions to prevent such leakage from occurring.

In the unassembled state as viewed in FIG. 5, a plurality of plastic molded upper body components 24 can be assembled in a compact nested or stacked array for convenient, space-efficient shipment and/or storage. In a similar manner, in the unassembled state as viewed in FIG. 6, a plurality of plastic molded lower base components 14 can be stacked in a compact nested array for similarly compact shipment and/or storage. These components 24 and 26 can be snap-fit assembled when desired, quickly and easily, to form the assembled modular wine glass 10. After use, the plastic glass 10 can be discarded, or, if desired, disassembled for appropriate cleaning and compact storage preparatory to re-use.

In accordance with a further aspect of the invention, the upper body component 24 incorporates the indented notch 20 at the outboard side thereof, preferably at a position near a vertical midpoint of the assembled modular glass 10. This indented notch 20 is defined in part at a lower end thereof by the substantially horizontal shelf 22 having a relatively narrow but sufficient horizontal depth to accommodate convenient fingertip grasping as by the tip of a person's thumb. An outboard margin of this shelf 22 may include a short upstanding and generally horizontally elongated rib 38 for further enhanced fingertip grasping and control. Accordingly, the assembled modular wine glass 10 can be readily grasped and manipulated with the fingertips, such as with the thumb and forefinger, in the course of inspecting and drinking wine contained therein.

In this regard, the shelf 22 with rib 38 is readily grasped by the thumb, while lifting the assembled glass 10 with the forefinger and/or middle finger engaging the lower base 14 and/or engaging a lower peripheral margin or edge generally at the lip 34, for easy and convenient lifting of the assembled glass 10 substantially to eye and nose level for optimal inspection of wine contained within the glass. The fingertip-grasped modular glass 10 can be held and manipulated easily by means of the notched shelf 22 and associated rib 38 for holding the glass 10 near the person's nose in the course of enjoying and/or grading the bouquet of the wine contained within the glass. In addition, the notched shelf 22 facilitates further manipulation of the glass for swirling close to the holder's eyes for visually inspecting a small quantity of wine contained within the lower end thereof, within or substantially filling the annular moat 18, particularly due to enhanced lighting effect attributable to the punt 16. Importantly, such manipulation and lifting of the wine glass 10 may occur substantially in the absence of grasping or smudging any extended surface area of the upper body 24 or the lower base 14. Moreover, such fingertip handling of the glass 10 minimizes surface area contact between the person's body and the glass, thereby also minimizing undesirable heat transfer from the person to the wine or the like contained within the glass. The shelf 22 further accommodates handling of the modular glass 10 in the course of drinking the wine.

Figure 2:
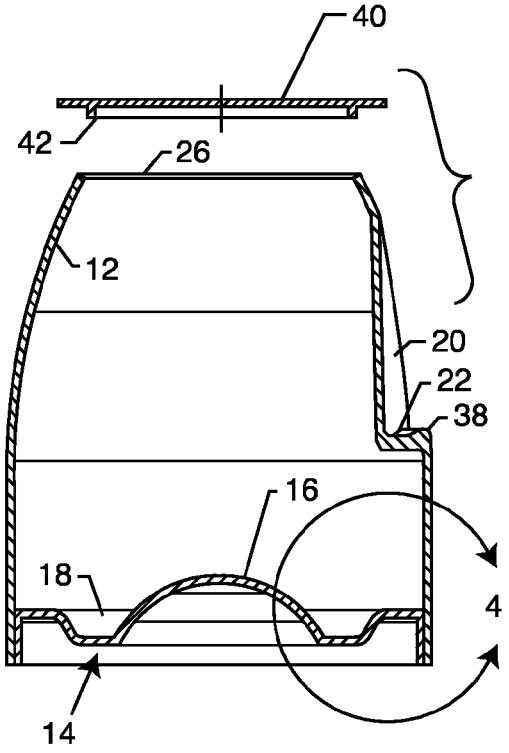
FIG. 2 is an enlarged vertical sectional view of the module wine glass taken generally on the line 2-2 of FIG. 1, and further illustrating a removable lid in exploded relation thereto.
Figure 3:
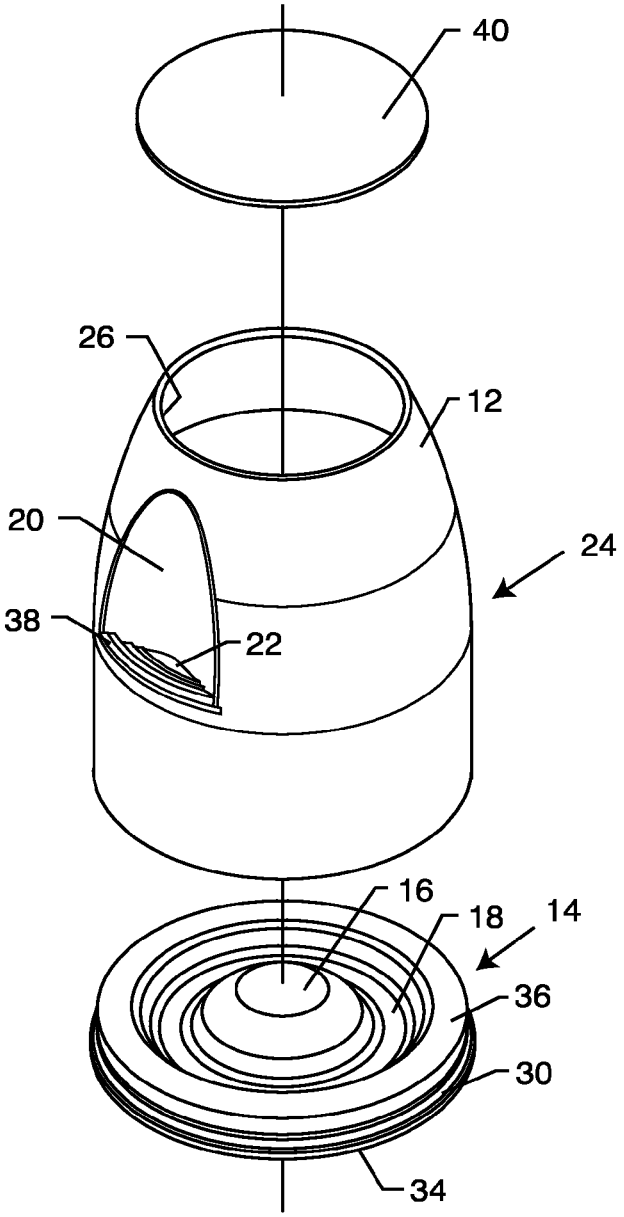
FIG. 3 is an exploded perspective view showing assembly of the components forming the modular wine glass.
Figure 4:
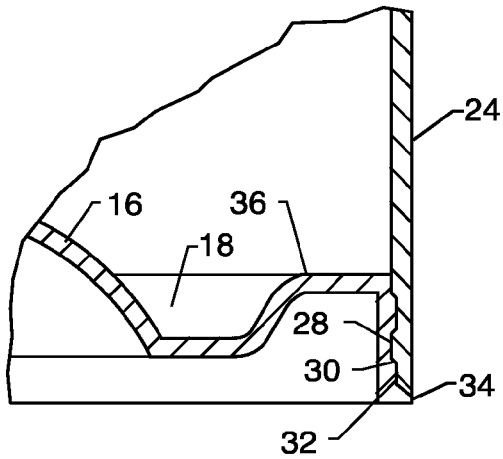
FIG. 4 is an enlarged and fragmented sectional corresponding generally with the encircled region 4 of FIG. 2.

If desired, a removable lid 40 may also be provided as a third component formed from molded plastic as by injection molding or the like, and adapted for removable mounting as by snap-fit connection onto the upper body component 24 to close the mouth 26 of the assembled glass 10. This lid component 40 is shown in FIGS. 2-3 in the form of a generally circular disk having a size and shape to overlie the open mouth 26, and further includes a depending annular lip 42 sized for snap-fit reception into the mouth 26. With this construction, the lid component 40 can be assembled and disassembled with the glass, as desired. The lid 40 (or the upper body 24) may also carry a label (not shown) or include a writable frosted region (also not shown) for identifying the vintage contained within the glass. Moreover, in the unassembled state, a plurality of lid components 40 can also be stacked in a compact array (not shown) for convenient shipping and storage.

FIGS. 7-10 illustrate an alternative preferred form of the invention wherein a modified wine glass 110 has a unitary or one-piece construction but otherwise incorporates structural and functional features identified by reference numerals common to the embodiment shown and described in FIGS. 1-6.

Figure 7:
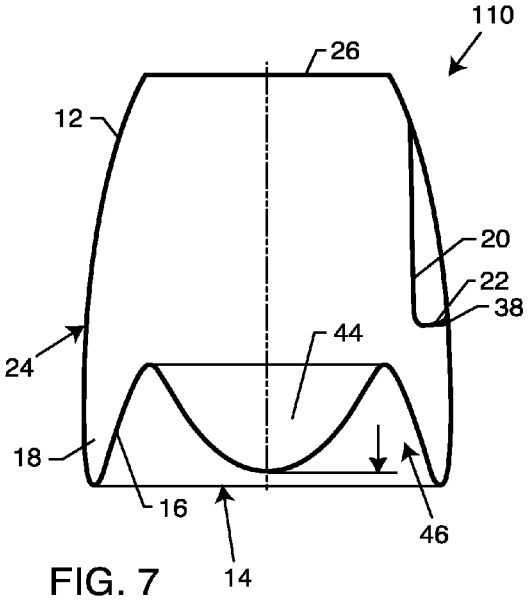
FIG. 7 is a vertical sectional view similar to FIG. 2, but depicting an alternative preferred form of the present invention.

More particularly, as viewed in FIG. 7 in vertical section, the modified wine glass 110 comprises an upper body 24 having a generally cylindrical cross sectional shape generally conforming with the embodiment of FIGS. 1-6, to include the upwardly narrowing upper flume 12 terminating at an upper edge or margin in the open mouth 26. A lower edge or margin of the upper body 24 is joined integrally with a one-piece construction to the lower base 14. The upper body 24 further includes the notched external indent 20 defining the shallow shelf 22 and associated raised rib 38. This one-piece wine glass 110 is also preferably constructed from a lightweight and relatively economical plastic material such as a plastic material suitable for blow mold processes such as PET plastic and the like.

The lower base 14 of the one-piece wine glass 110 includes the annular moat 18 defined cooperatively at the lower periphery of the glass interior volume between a lower region of the upper body 24 and a central upstanding punt 16. In this embodiment, the punt 16 defines an upstanding annular wall formed to extend angularly upwardly and inwardly at a relatively steep angle from a lower margin of the upper body 24, whereby the moat-defining walls diverge upwardly from each other at an included angle on the order of about 10-20 degrees. This geometry provides extensive and improved viewing of the visual characteristics of wine contained within the moat 18.

In addition, the inboard moat-forming wall defined by the punt 16 is joined at an upper marginal edge thereof in circumscribing relation with an upwardly open, upwardly concave central inner bowl or cup 44 of predetermined or metered liquid volumetric capacity for pour-in reception of a measured quantity of wine. This central cup 44 is defined by a downwardly convex geometry that functions as a refracting or reflecting lens to enhance the light passing through wine contained within the cup 44, for correspondingly enhanced visual inspection of the wine color, clarity and meniscus. Alternately, persons skilled in the art will understand that the upstanding punt 16 shown in FIGS. 7-8 may have an upwardly convex shape as shown in FIGS. 1-6, or that the punt 16 shown in FIGS. 1-6 may incorporate the central cup 44.

Figure 8:
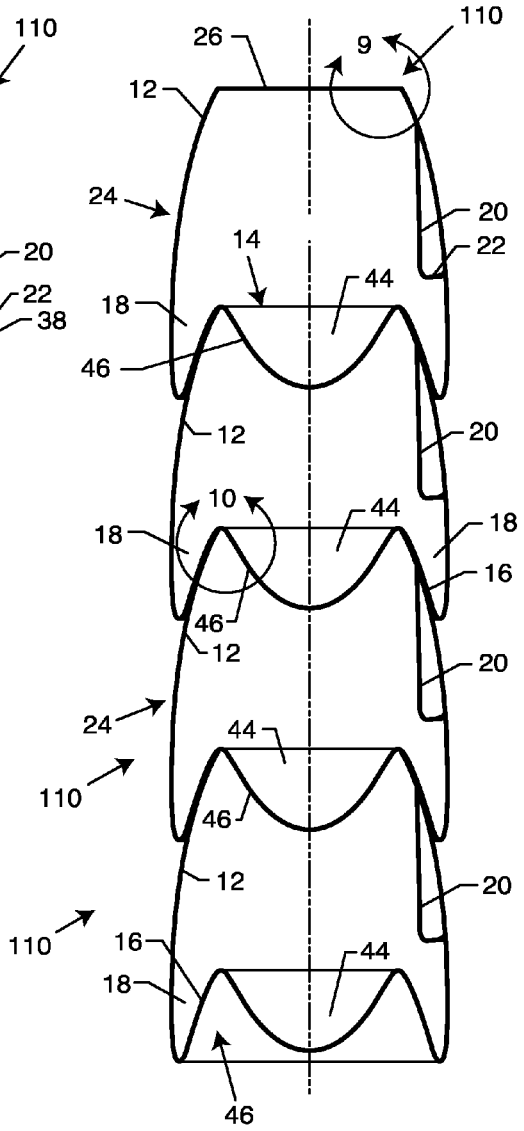
FIG. 8 is a vertical sectional view similar to FIG. 5, but showing a plurality of wine glasses constructed in accordance with the embodiment of FIG. 7 in compact stacked relation.
Figure 9:
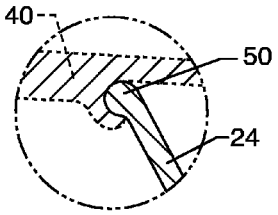
FIG. 9 is an enlarged fragmented sectional view corresponding generally with the encircled region 9 in FIG. 8.
Figure 10:
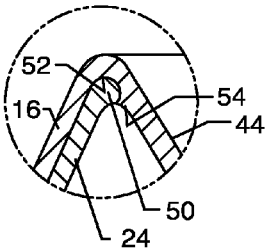
FIG. 10 is an enlarged fragmented sectional view corresponding generally with the encircled region 10 in FIG. 8.

In use, the modified wine glass 110 shown in FIGS. 7-8 is adapted for pour-in reception of a metered quantity of wine into the upwardly open central bowl or cup 44. The wine glass 110 can be grasped and manipulated as described previously with respect to FIGS. 1-6, for visually inspecting the wine within the cup 44. In addition, the wine glass can be manipulated to tip and thereby transfer the wine from the cup 44 into the surrounding moat 18 for further visual and olfactory inspection as previously described. Such manipulation of the wine glass 110 is accomplished easily by grasping the glass with minimal surface area contact between the person's fingertips and the glass, e.g., with the thumb and forefinger (and/or middle finger) respectively at the indented notch 20 and a lower marginal edge defined by the juncture of the upper body 24 and the upwardly extending wall forming the punt 16, substantially without distorting wine viewing with fingerprints or other smudges.

More particularly, the central cup 44 is designed to receive a liquid beverage such as wine for the purpose of improved viewing, measuring and tasting of the beverage. In a preferred form, the central cup 44 defines a relatively broad upwardly presented and upwardly open surface area aligned generally with the open upper mouth of the glass, so that the beverage can be poured from above directly into the central cup 44, substantially without any significant portion of the beverage splashing or otherwise into or otherwise filling the surrounding moat 18. In this regard, the circumferential opening defined by the cup 44 is generally coaxially aligned with the mouth 26 and has a circumferential size of at least about ½ and preferably substantially equal to the circumferential size of the mouth 26. In the preferred geometry, the tapered flume geometry of the upper body 24 at least partially and preferably completely overlies the surrounding moat 18 so that direct-pour of the beverage through the mouth 26 and into the moat 18 is substantially precluded. That is, the moat 18 is, in the preferred form, positioned substantially in an undercut position relative to the rim of the glass defining the mouth 26, with the uppermost margin of the punt 16 aligned generally vertically with the glass rim.

In addition, the central cup 44 defines a liquid volume or capacity for receiving a sufficient yet limited and preferably metered quantity of the beverage for appropriate visual and olfactory inspection and judging, etc. A preferred capacity for the central cup 44 is within the range of from about ½ ounce to about 2 ounces, and most preferably about 1 ounce.

The central cup 44 accommodates manipulation of the glass 110 to swirl the beverage therein during this inspection process. The glass can be tipped from a vertical orientation to an angle on the order of about 45° so that the beverage can be swirled and spilled slowly over the uppermost margin of the punt 16 in a controlled or regulated flow into the surrounding moat 18. This process beneficially facilitates and enhances examination and judging characteristics such as color and viscosity of a beverage such as wine, and thereby increases enjoyment of the beverage. The glass 110 is especially suited for beverage examination and analysis, e.g., at a wine tasting event.

The one-piece wine glass 110 is also adapted for relatively compact stacking as viewed in FIG. 8. That is, the underside of the lower base 14 of each glass 110 defines an annular cavity 46 between the upstanding wall of the punt 16 and the downwardly convex central bowl or cup 44, wherein this cavity 46 has a size and shape for substantially nested partial reception of the upwardly narrowing flume 12 on the upper body 24 of an underlying glass 110 in the stack. In particular, the upwardly narrowing taper of the flume 12 is sized and shaped to substantially match the upwardly and inwardly tapered geometry of the punt wall, whereby these components are shaped and sized and essentially aligned vertically for relatively snug and substantially stable slide-fit interconnection when stacked. With this geometry, multiple glasses 110 can be stacked in a secure and stable manner in a partially filled condition, i.e., containing wine within the central cup 44 of each stacked glass 110 for convenient and rapid distribution to individuals, or alternately stacked in a secure and stable manner in an unfilled condition for relatively compact shipment and/or storage prior to or between uses.

Stacking of the multiple glasses 110 in a secure and stable manner is enhanced by forming the upper rim of each glass at the open mouth 26 to incorporate a rounded and slightly enlarged or thick-walled bead 50 (FIGS. 9 and 10) for snap-fit engagement with a matingly shaped detent channel 52 (FIG. 10) formed at the underside of each glass 110 generally at the transition between the upwardly extending inner wall or punt 16 of the moat 18 and the downwardly extending wall defining the central bowl or cup 44. In the preferred form, this detent channel 52 may be defined by a plurality, typically three or more, of circumferentially spaced shallow detent protrusions 54, although persons skilled in the art will recognize that an annular detent protrusion may be used if desired. The snap-fit interlocked stack of glasses 110 thus provides a stable array wherein the glasses 110 can be pre-filled each with a measured quantity of wine or the like, and with each underlying glass in the stack being substantially closed and sealed by the immediately overlying glass snap-fit attached thereto. In addition, the rounded bead 50 on the uppermost glass 110, or on each glass in an unstacked array, may be used for snap-fit mounting of a cap 40 (shown in dotted lines in FIG. 9) of the type shown and described in FIGS. 2-3. The pre-filled stacked glasses 110 can thus be prepared in advance for distribution yet maintained substantially sealed until actual distribution which may occur in a convenient and rapid manner.

In accordance with further aspects of the invention, the curved, downwardly convex shape of the inner bowl or cup 44 cooperates with the externally convex shape of the body 24 to magnify the liquid contents of the one-piece glass 110 under certain conditions. In particular, liquid such as wine contained within the cup 44 is magnified when viewed from the top of the glass 110, thereby permitting facilitated and closer inspection of the characteristics of the liquid. In addition, in the illustrative configuration as shown, a focal zone is believed to be created within a region extending generally from about ½ inch above the top of the central bowl or cup 44 to about ½ inch below the beaded upper rim 50 lining the mouth 26. Within this focal zone or region, and with the glass filled with liquid to approximately ½ inch below the beaded rim 50, a magnification effect due to light entering the transparent bottom and lower sides of the body 24 is believed to occur as light is refracted upwardly. The net effect of liquid within this focal zone magnifies liquid within the lower inner cup 44.

A variety of further modifications and improvements in and to the improved modular wine glass 10 and/or the unitary wine glass 110 of the present invention will be apparent to those persons skilled in the art. By way of example, the modified wine glass 110 may also incorporate a label or writable frosted zone (not shown) on the upper body 24. Accordingly, no limitation on the invention is intended by way of the foregoing description and accompanying drawings, except as set forth in the appended claims.

What is claimed is:

1. A beverage glass, comprising:

an upper generally shell-shaped body terminating at an upper rim in an open mouth;

a lower base at a lower end of said upper body, said lower base defining a recessed annular moat surrounding an upstanding central punt; and an upwardly concave central inner cup circumscribed by and extending downwardly into said punt, said inner cup having an outer convex surface entirely externally accessible for convenient fingertip support;

wherein said upper body, said lower base, and said inner cup are substantially transparent; and wherein said upper body and said central cup cooperatively define a focal zone extending generally from about ½ inch above said cup to about ½ inch below said mouth to magnify light entering the glass through said cup, for correspondingly magnifying liquid contained within said cup.

2. The beverage glass of claim 1 wherein said shell-shaped body defines an upwardly narrowing tapered flume terminating in said rim defining said open mouth.

3. The beverage glass of claim 2 wherein said rim is positioned in substantial vertical alignment with said punt.

4. The beverage glass of claim 1 wherein said upper body further includes an external notched indent formed therein and defining an exterior shelf having a size and shape for convenient fingertip grasping.

5. The beverage glass of claim 1 wherein said moat is cooperatively defined by an inner moat wall and an outer moat wall defining an included angle of about 10-20 degrees.

6. The beverage glass of claim 1 wherein said glass is constructed from plastic.

7. The beverage glass of claim 1 wherein said upper body, said lower base, and said inner cup comprise a unitary one-piece construction.

8. The beverage glass of claim 1 wherein said upper rim is of a size and shape for nested and partial mating reception of said lower base to accommodate stacking of a plurality of glasses.

9. The beverage glass of claim 1 further including a lid for removably closing said mouth.

10. The beverage glass of claim 1 wherein said inner cup is generally coaxially aligned with said mouth and has a circumferential size of at least about ½ the circumferential size of said mouth.

11. A beverage glass, comprising:

an upper generally shell-shaped body terminating at an upper rim in an open mouth;

a lower base defining a recessed annular moat at a lower end of said upper body, said annular moat cooperatively defined by an inner moat wall defining a central punt and an outer moat wall, together said inner moat wall and said outer moat wall define an included angle of about 10-20 degrees; and an upwardly concave central inner cup circumscribed by and extending downwardly into said punt, said inner cup having an outer convex surface entirely externally accessible for convenient fingertip support;

wherein said upper body, said lower base, and said inner cup are substantially transparent.

12. The beverage glass of claim 11 wherein said shell-shaped body defines an upwardly narrowing tapered flume terminating in said rim defining said open mouth.

13. The beverage glass of claim 12 wherein said rim is positioned in substantial vertical alignment with said punt.

14. The beverage glass of claim 11 wherein said upper body further includes an external notched indent formed therein and defining an exterior shelf having a size and shape for convenient fingertip grasping.

15. The beverage glass of claim 11 wherein said glass is constructed from plastic.

16. The beverage glass of claim 11 wherein said upper body, said lower base, and said inner cup comprise a unitary one-piece construction.

17. The beverage glass of claim 11 wherein said upper body and said central cup cooperatively define a focal zone extending generally from about ½ inch above said cup to about ½ inch below said mouth to magnify light entering the glass through said cup, for correspondingly magnifying liquid contained within said cup.

18. The beverage glass of claim 11 wherein said upper rim is of a size and shape for nested and partial mating reception of said lower base to accommodate stacking of a plurality of glasses.

19. The beverage glass of claim 11 further including a lid for removably closing said mouth.

20. The beverage glass of claim 11 wherein said inner cup is generally coaxially aligned with said mouth and has a circumferential size of at least about ½ the circumferential size of said mouth.

21. A beverage glass, comprising:

a generally shell-shaped body defining an upwardly narrowing tapered flume terminating in a rim terminating in an open mouth, said shell-shaped body further including an external indent formed therein defining an exterior shelf having a size and shape for convenient fingertip grasping;

a base at a lower end of said shell-shaped body, said base defining a recessed annular moat surrounding an upstanding central punt, wherein said moat is cooperatively defined by an inner moat wall and an outer moat wall defining an included angle of about 10-20 degrees; and an upwardly concave central inner cup circumscribed by and extending downwardly into said punt and having an outer convex surface entirely externally accessible for convenient fingertip support;

wherein said upper body, said lower base, and said inner cup are substantially transparent.

22. The beverage glass of claim 21 wherein said external indent comprises a non-circumferential notched indent.

23. The beverage glass of claim 21 wherein said upper body and said central cup cooperatively define a focal zone extending generally from about ½ inch above said cup to about ½ inch below said mouth to magnify light entering the glass through said cup, for correspondingly magnifying liquid contained within said cup.

24. The beverage glass of claim 21 wherein said upper body, said lower base, and said inner cup comprise a unitary one-piece construction.

25. The beverage glass of claim 21 wherein said rim is of a size and shape for nested and partial mating reception of said base to accommodate stacking of a plurality of glasses.

26. A beverage glass, comprising:

an upper generally shell-shaped body defining an upwardly narrowing tapered flume terminating in a rim terminating in an open mouth; said upper body further including an external notched indent formed therein defining an exterior shelf having a size and shape for convenient fingertip grasping;

a lower base at a lower end of said upper body, said lower base defining a recessed annular moat surrounding an upstanding central punt, wherein said moat is cooperatively defined by an inner moat wall and an outer moat wall defining an included angle of about 10-20 degrees; and an upwardly concave central inner cup circumscribed by and extending downwardly into said punt and having an outer convex surface entirely externally accessible for convenient fingertip support, said rim being positioned substantially coaxial with said punt;

wherein said upper body, said lower base, and said inner cup comprise a unitary one-piece construction.

27. The beverage glass of claim 26 wherein said upper body, said lower base, and said inner cup are substantially transparent and said external notched indent comprises a non-circumferential notched indent.

28. The beverage glass of claim 26 wherein said upper body and said central cup cooperatively define a focal zone extending generally from about ½ inch above said cup to about ½ inch below said mouth to magnify light entering the glass through said cup, for correspondingly magnifying liquid contained within said cup.

29. A beverage glass, comprising:

a generally shell-shaped body defining an upwardly narrowing tapered flume terminating in a rim terminating in an open mouth, said shell-shaped body further including an external indent formed therein defining an exterior shelf having a size and shape for convenient fingertip grasping;

a base at a lower end of said shell-shaped body, said base defining a recessed annular moat surrounding an upstanding central punt; and an upwardly concave central inner cup circumscribed by and extending downwardly into said punt and having an outer convex surface entirely externally accessible for convenient fingertip support;

wherein said upper body, said lower base, and said inner cup are substantially transparent; and wherein said upper body and said central cup cooperatively define a focal zone extending generally from about ½ inch above said cup to about ½ inch below said mouth to magnify light entering the glass through said cup, for correspondingly magnifying liquid contained within said cup.

30. The beverage glass of claim 29 wherein said external indent comprises a non-circumferential notched indent.

31. The beverage glass of claim 29 wherein said moat is cooperatively defined by an inner moat wall and an outer moat wall defining an included angle of about 10-20 degrees.

32. The beverage glass of claim 29 wherein said upper body, said lower base, and said inner cup comprise a unitary one-piece construction.

33. The beverage glass of claim 29 wherein said rim is of a size and shape for nested and partial mating reception of said base to accommodate stacking of a plurality of glasses.

34. A beverage glass, comprising:

an upper generally shell-shaped body defining an upwardly narrowing tapered flume terminating in a rim terminating in an open mouth; said upper body further including an external notched indent formed therein defining an exterior shelf having a size and shape for convenient fingertip grasping;

a lower base at a lower end of said upper body, said lower base defining a recessed annular moat surrounding an upstanding central punt; and an upwardly concave central inner cup circumscribed by and extending downwardly into said punt and having an outer convex surface entirely externally accessible for convenient fingertip support, said rim being positioned substantially coaxial with said punt;

wherein said upper body, said lower base, and said inner cup comprise a unitary one-piece construction; and wherein said upper body and said central cup cooperatively define a focal zone extending generally from about ½ inch above said cup to about ½ inch below said mouth to magnify light entering the glass through said cup, for correspondingly magnifying liquid contained within said cup.

35. The beverage glass of claim 34 wherein said upper body, said lower base, and said inner cup are substantially transparent and said external notched indent comprises a non-circumferential notched indent.

36. The beverage glass of claim 34 wherein said moat is cooperatively defined by an inner moat wall and an outer moat wall defining an included angle of about 10-20 degrees.

* * * * *